US010772164B2

(12) United States Patent
Puchinger et al.

(10) Patent No.: US 10,772,164 B2
(45) Date of Patent: Sep. 8, 2020

(54) HOB COMPRISING HEATING ZONE ILLUMINATION MEANS

(71) Applicant: ELECTROLUX APPLIANCES AKTIEBOLAG, Stockholm (SE)

(72) Inventors: Bianca Puchinger, Rothenburg ob der Tauber (DE); Jochen Holzinger, Rothenburg ob der Tauber (DE); Anne Weinmann, Rothenburg ob der Tauber (DE); Filippo Martini, Forli (IT); Jennifer Burkhardt, Rothenburg ob der Tauber (DE); Michael Herzog, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 291 days.

(21) Appl. No.: 15/573,616

(22) PCT Filed: May 31, 2016

(86) PCT No.: PCT/EP2016/062276
§ 371 (c)(1),
(2) Date: Nov. 13, 2017

(87) PCT Pub. No.: WO2016/198287
PCT Pub. Date: Dec. 15, 2016

(65) Prior Publication Data

US 2018/0124879 A1 May 3, 2018

(30) Foreign Application Priority Data

Jun. 10, 2015 (EP) ..... 15171296

(51) Int. Cl.
*H05B 6/12* (2006.01)
*H05B 3/74* (2006.01)
*H05B 6/06* (2006.01)

(52) U.S. Cl.
CPC ..... *H05B 6/1218* (2013.01); *H05B 3/746* (2013.01); *H05B 6/062* (2013.01); *H05B 2213/03* (2013.01); *H05B 2213/05* (2013.01)

(58) Field of Classification Search
CPC ..... H05B 6/1218; H05B 3/746
(Continued)

(56) References Cited

U.S. PATENT DOCUMENTS 8,772,678 B2 * 7/2014 Shigeoka ..... F24C 7/083 219/220

FOREIGN PATENT DOCUMENTS

CN 1669360 9/2005
CN 102047755 5/2011
(Continued)

OTHER PUBLICATIONS

International Search Report and Written Opinion for PCT/EP2016/062276 dated Aug. 9, 2016, 10 pages.
(Continued)

*Primary Examiner* — Christine J Skubinna
(74) *Attorney, Agent, or Firm* — Pearne & Gordon LLP

(57) ABSTRACT

The invention relates to a hob comprising a transparent or semi-transparent hob plate (2) and multiple heating elements (3) arranged below said hob plate (2), the hob further comprising illumination means arranged below said hob plate (2) for providing light markings (4) at the upper side (2.1) of the hob plate (2), said light markings (4) indicating heating zones (5) associated with the heating elements (3), wherein the illumination means comprise a light box (10) with at least a bottom wall portion (11) and a pair of side wall portions (12), said light box (10) including one or more lighting elements (13) for illuminating an interior space (14) of the light box (10), wherein the light box (10) further comprises an upper portion (15) being adapted to emit light
(Continued)

towards the hob plate (2) in order to provide said light marking (4) at the upper side of the hob plate (2).

18 Claims, 4 Drawing Sheets

(58) Field of Classification Search
USPC ..... 219/452.11
See application file for complete search history.

(56) References Cited

FOREIGN PATENT DOCUMENTS

| | | |
|---|---|---|
| CN | 102474920 | 5/2012 |
| CN | 1669360 | 9/2014 |
| CN | 104604329 | 5/2015 |
| DE | 29902875 | 8/1999 |
| EP | 2252129 | 11/2010 |
| EP | 2458935 | 5/2012 |
| JP | 2014044823 | 3/2014 |
| JP | 5573036 | 8/2014 |
| WO | 2012001300 | 1/2012 |
| WO | 2012059664 A1 | 5/2012 |

OTHER PUBLICATIONS

EP Communication for application No. 15171296.5, dated Dec. 11, 2019, 6 pages.
CN OA for application No. 201680033049A, dated Apr. 2, 2020, 7 pages.

* cited by examiner

HOB COMPRISING HEATING ZONE ILLUMINATION MEANS

The present invention relates generally to the field of hobs. More specifically, the present invention is related to illumination means for illuminating heating zones of a hob.

BACKGROUND OF THE INVENTION

Hobs for preparing food are well known in prior art. Hobs typically comprise multiple heating zones which are associated with one or more heating elements. The heating elements may be resistance heating elements or induction coils (in case of an induction hob).

Hobs often comprise hob plates with a pure design and a smooth surface. For example, the hob plate may be a glass ceramic plate. In order to indicate heating zones at the hob plate, markings in form of printed lines may be provided at the upper surface of the hob plate.

In order to increase the flexibility, hobs may provide the possibility of bridging multiple heating zones in order to form a large-area heating zone.

SUMMARY OF THE INVENTION

It is an objective of the embodiments of the invention to provide a hob with heating zone markings which can be easily adapted according to the chose shape of the heating zone without any fixed, visually disturbing markings at the upper side of the hob plate. If not explicitly indicated otherwise, embodiments of the invention can be freely combined with each other.

According to an aspect, the invention relates to a hob. The hob comprises a transparent or semi-transparent hob plate and multiple heating elements arranged below said hob plate. For example, the hob-plate is a glass ceramic hob plate. The hob further comprises illumination means arranged below said hob plate for providing light markings at the upper side of the hob plate, said light markings indicating heating zones associated with the heating elements. The illumination means comprise one or more light boxes, each light box comprising at least a bottom wall portion and a pair of side wall portions. The light box further includes one or more lighting elements for illuminating an interior space of the light box and an upper portion being adapted to emit light provided by the lighting elements towards the hob plate. In other words, the light box comprises a light emitting portion emitting light through the transparent or semi-transparent hob plate thereby providing said light marking at the upper side of the hob plate. The lighting elements may be bulbs or, preferably, light emitting diodes.

The proposed hob is advantageous because the light marking can be varied according to the size and shape of the currently used heating zone. Furthermore, in a switched-off state, no light marking is provided at the hob plate thereby avoiding visually disturbing markings.

According to embodiments, the bottom wall portion and the side wall portions are integrally formed at the light box. In other words, the light box comprises a U-shaped or essentially U-shaped single-piece profile. Advantageously, such profile can be manufactured with low effort.

According to embodiments, at least one wall portion, specifically a side wall portion of the light box comprise one or more apertures through which light is emitted into the interior space of the light box. Said apertures may penetrate the whole side wall portion thereby providing a light passage through which light is provided into the interior of the light box. According to other embodiments, the lighting elements may be directly arranged in the interior of the light box. For example, a printed circuit board may be arranged at the bottom wall portion or one of the side wall portions, said printed circuit board comprising the lighting elements.

According to embodiments, the bottom wall portion is formed by a circuit board comprising said lighting elements. Thereby, the structure of the light box is simplified and the construction height is reduced.

According to embodiments, the wall portions of the light box comprise a light blocking material or a light-blocking finishing or coating at the outer side. Thereby, an emission of light through the bottom wall portion and/or the side wall portions is avoided.

According to embodiments, the interior surface of the light box is adapted to diffuse and/or reflect light. Thereby, the light is distributed within the interior of the light box thereby providing a homogenized light emission out of the light box. Preferably, the interior surface of the light box does not show a mirroring surface.

According to embodiments, at least the side wall portions of the light box are made of white, non-transparent material or comprise a light-dispersive and/or light-reflecting coating. Thereby, an emission of light through the side wall portions causing an undesirable ambient lighting of the hob plate is avoided.

According to embodiments, the light box comprises at the top side a light diffusing portion which faces the bottom side of the hob plate. In other words, the upper portion providing the emission of light to the hob plate is adapted to diffuse the light provided by the lighting elements. In yet other words, said diffusing portion is adapted to evenly distribute the light. Thereby, an even light distribution along the upper side of the light box is achieved which leads to a provision of homogenous light markings at the upper side of the hob plate. The light diffusing portion may be made by a rigid diffusor plate or a diffusor foil.

According to embodiments, the hob comprises a lid which partially covers an opening of the light box. Thereby, a narrowed light emitting aperture is provided which is adapted to the desired line width of the light marking. Alternatively or in addition, the bottom side of the hob plate may comprise a printing or coating providing a well-confined light transmission slot in order to laterally confine the light marking.

According to embodiments, the light box, specifically the bottom and side wall portions, are made of a heat resistant material, specifically polybutylene terephthalate. According to other embodiments, the said wall portions are made of metal.

According to embodiments, the hob comprises multiple light boxes being arranged at different positions below said hob plate and the lighting elements included in the respective light boxes are driven such that a heating zone formed by one or more heating elements is highlighted at the upper side of the hob plate. In other words, only a subset of light boxes is activated in order to highlight the shape and size of currently activated heating zones. Thereby, it is possible to adapt the light markings of the heating zones to the current heating zone configuration.

According to embodiments, multiple light boxes are adapted to highlight heating zones by completely bordering said heating zones by a solid illumination line or by partially bordering the heating zones by broken lines. For example, broken lines may form brackets at the corners or edges of the heating zones. In addition one or more light dots may be provided to indicate the centre of the heating zone.

According to embodiments, the hob comprises a control unit being adapted to control illumination properties provided by the light box based on the cooking level. For example, the control unit may be adapted to change the light intensity, colour, line width and/or number of lines of the light markings based on the current cooking level. Said multiple light markings may be obtained by multiple light boxes being arranged next to each other. Thereby it is possible to visualize not only the size and shape of the heating zone but also the cooking level provided by said heating zone.

According to embodiments, the hob comprises control means for selecting the size or shape of a heating zone and the light marking provided by said light box is adapted based on the selected size of the heating zone. So, in other words, the size or shape of the heating zone can be manually adapted by a user input and the light marking is adapted accordingly. Alternatively, the hob comprises a pot detection mechanism for choosing an appropriate size of the heating zone and the light marking indicating the size of the heating zone is adapted based on information provided by the pot detection mechanism. So, in case of a pot detection mechanism, the light marking is automatically adapted based on the detected size and shape of the used piece of cookware.

The term "essentially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
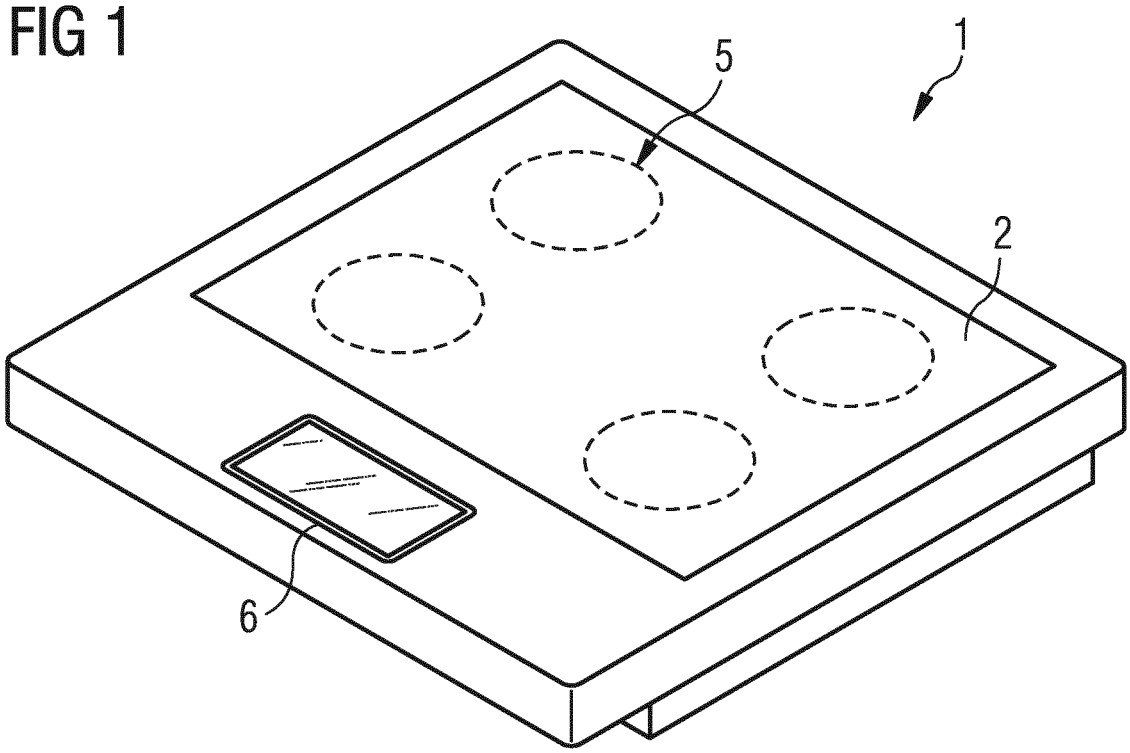
FIG. 1 shows an example schematic perspective view of a hob.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 shows a schematic illustration of a hob 1. The hob 1 may be, for example, an induction hob or a hob using resistance heating elements (resistance heating hob). The hob 1 comprises multiple heating zones 5 preferably provided at a common hob plate 2. Each heating zone 5 is correlated with at least one heating element 3 placed beneath the hop plate 2. Said heating elements 3 may be induction heating elements (e.g. an induction coil) or resistance heating elements. The induction hob 1 may further comprise a user interface 6 for receiving user input and/or providing information, specifically graphical information to the user. Preferably, the hob 1 may comprise heating zones 5 of variable size, i.e. the size of the heating elements can be adapted to the present needs, e.g. the size of a currently used piece of cookware. The size of the heating zone may be varied by aggregating multiple heating elements 3 in order to obtain a large-size heating zone 5 or switch off one or more heating elements 3 associated with a heating zone 5 in order to reduce its size.

In order to provide flexible heating zone markings which can be adapted according to the present size/shape of a heating zone 5, the hob 1 is adapted to provide light markings 4 at the upper side 2.1 of the hob plate 2.

Figure 2:
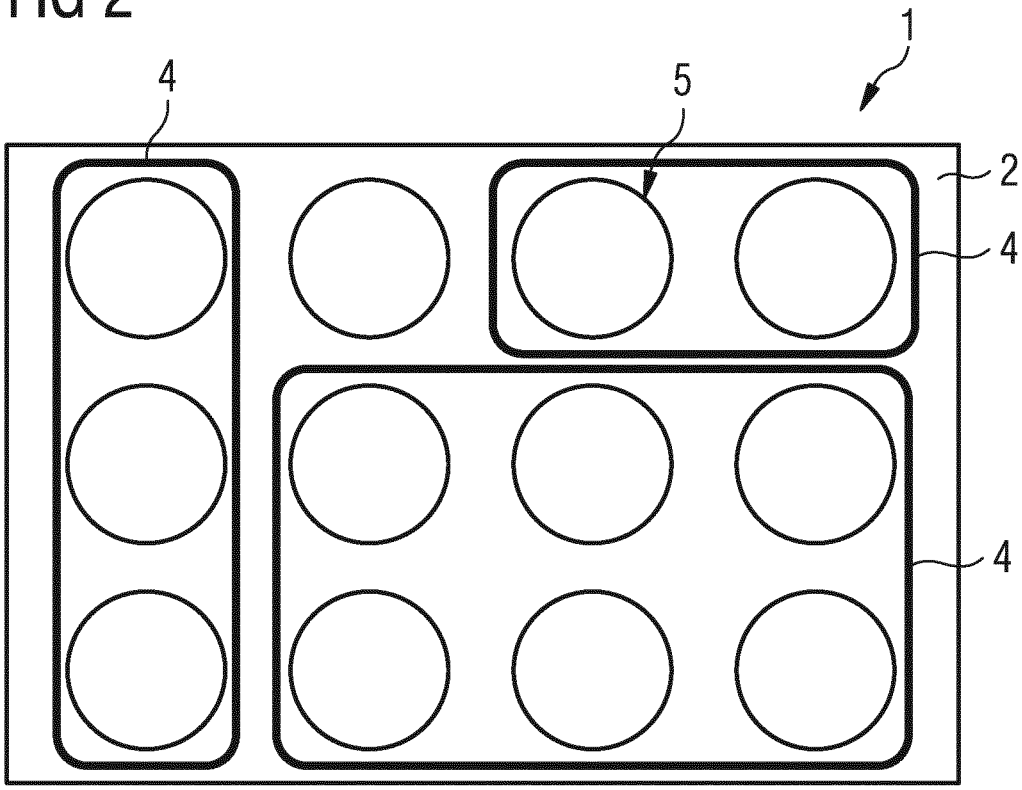
FIG. 2 shows an example schematic top view of a hob comprising multiple light markings indicating activated heating zones.

FIG. 2 shows an example arrangement of multiple heating elements 3. Said heating elements 3 may be arranged in a matrix-like manner, i.e. the hob 1 may comprise heating elements 3 arranged in rows and columns. The bold lines indicate light markings 4 surrounding heating zones 5. The heating elements 3 associated with a certain heating zone 5 may be driven with the same electrical properties (e.g. electrical heating power) in order to form a heating zone 5 with an equal heating power distribution. The formation of the respective heating zones 5 may be manually chosen by the user based on the size and shape of the currently used piece of cookware. Alternatively, the formation of the heating zones 5 may be influenced by a pot detection mechanism. By means of said pot detection mechanism, the size/shape of the currently used piece of cookware may be detected automatically wherein the information provided by the pot detection mechanism is used for aggregating multiple heating elements 3 covered by a certain piece of cookware to a common heating zone 5.

Figure 3:
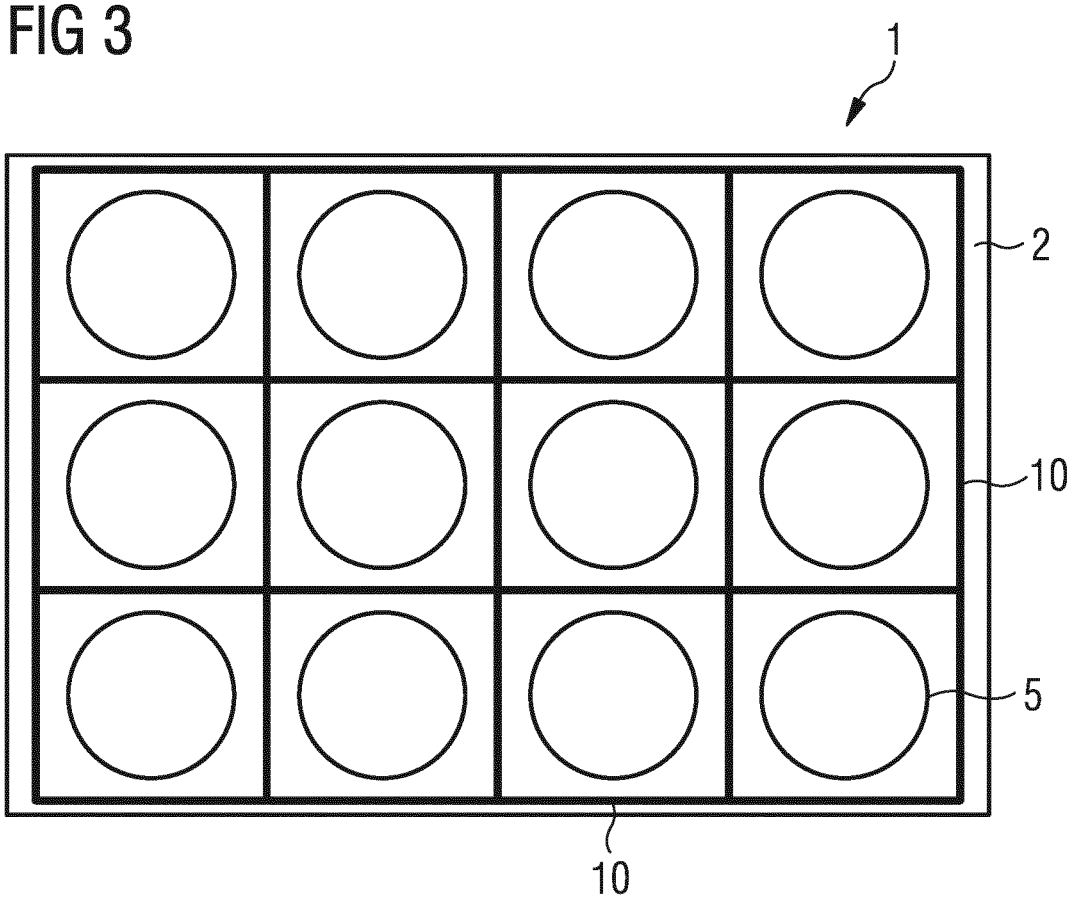
FIG. 3 shows an example schematic top view of a hob comprising multiple light boxes arranged in a matrix-like configuration.
Figure 4:
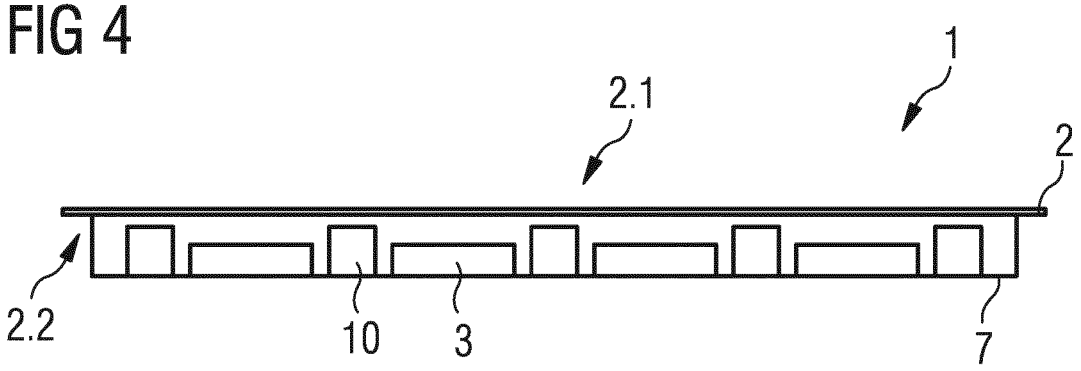
FIG. 4 shows an example schematic cross-sectional side view of a hob including light boxes.

FIGS. 3 and 4 show technical means for providing uppermentioned light markings 4 at the upper side 2.1 of the hob plate 2 in greater detail. The hob 1 comprises multiple light boxes 10 being arranged in the interior of the hob 1, i.e. at or close to the bottom side of the hob plate 2. The hob plate 2 may be of transparent or semi-transparent material, e.g. may be a glass-ceramic hob plate 2. The light boxes 10 may be arranged with respect to the heating elements 3 such that due to activating/deactivating of lighting elements 13 included in the light boxes 10, said light markings 4 may be provided at the upper side of the hob plate 2. For example, the light boxes 10 may be distributed over the hob plate 2. According to the present embodiment, the light boxes 10 may be arranged in rows and columns, specifically, in spaces between the heating elements 3 and at the outer edge of the heating area. The light boxes 10 may have a longitudinal shape and may extend through the whole or essentially the whole length and/or width of the hob plate 2. According to another embodiment, the light boxes may be segmented, i.e. may only partially surround a heating element 3 or a heating zone 5. The light boxes may have a linear shape (as shown in FIG. 3) or may have a curved shape (e.g. a bracket-like shape). When activating the lighting elements 13 within the light box 10, a stripe-like light may be emitted by the light box 10 and provided through the hob plate 2 thereby generating an illumination stripe at the upper surface of the hob plate 2. In addition, a masking may be provided at the bottom side 2.2 of the hob plate 2 in order to confine the illumination stripe. Said masking may be provided by a printing or coating at the bottom side 2.2 of the hob plate 2.

As shown in FIG. 4, the light boxes 10 are arranged below the hob plate 2. The light boxes 10 may be integrated within the hob in different ways. For example, the light boxes 10 may be directly arranged at the bottom side 2.3 of the hob plate 2, may be directly provided at the carrier plate 7 of the heating elements 3, may be arranged at said heating elements 3 or may be coupled with a bracket to said carrier plate 7.

Figure 5:
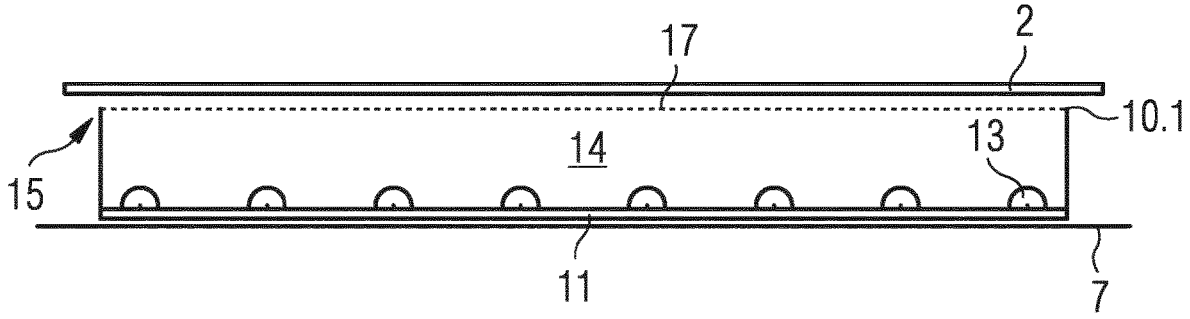
FIG. 5 illustrates an example schematic side view of a light box included in a hob.
Figure 6:
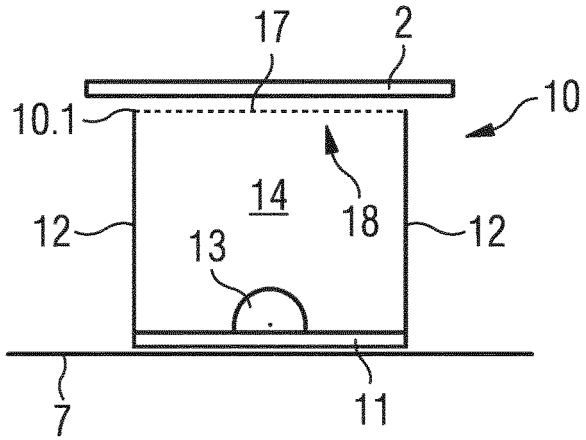
FIG. 6 illustrates an example schematic cross-sectional side view of a light box according to a first embodiment.
Figure 7:
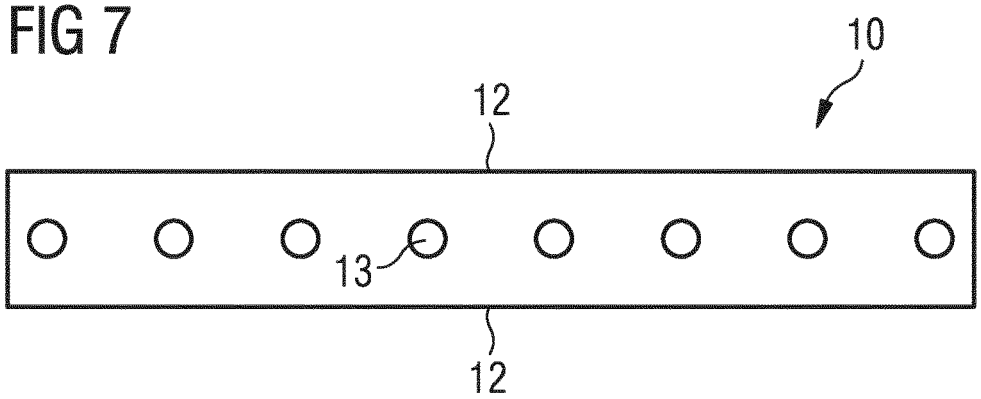
FIG. 7 shows an example schematic top view of a light box.

FIGS. 5 to 7 show an example embodiment of a light box 10 in closer detail. The light box 10 comprises an elongated shape, i.e. the longitudinal side is significantly longer than the narrow side. The light box 10 is formed by a profile made of a heat-resistant material, preferably by a plastic profile. The plastic may be, for example, polybutylene terephthalate (PBT).

The light box 10 is formed by a bottom wall portion 11 and two side wall portions 12 protruding from said bottom wall portion 11. The side wall portions 11 may be integrally formed at said bottom wall portion 11. Alternatively, the bottom wall portion 11 may be formed by a printed circuit board. Said side wall portions 12 and said bottom wall portion 11 may confine an interior space 14. At said bottom wall portion 11 in the interior space 14, one or more lighting elements 13 may be provided. Preferably, multiple lighting elements are distributed along the longitudinal side of the light box 10. Said lighting elements 13 may be, for example, light emitting diodes (LEDs) or electric light bulbs. According to the present embodiment, the light box is directly attached to the carrier plate 7 carrying the heating elements 3.

The wall portions of the light box 10 may be adapted to provide reflecting and dispersing of light emitted by the lighting elements 13. For example, at least the side wall portions may be made of white material (e.g. plastic) and/or may comprise a light-reflective or light-dispersive coating. Thereby, the light emitted by the lighting elements is distributed within the interior space in order to obtain a uniform light distribution, i.e. light markings 4 at the upper surface of the hob plate 2 with a uniform light intensity. For example, the inner coating may be white or may be shadowed from black to white. In addition, the side wall portions 12 and the bottom wall portion 11 could be made of non-transparent material or comprise a non-transparent coating in order to avoid a transmission of light through said walls which may lead to a lighting of the hob plate 2 in undesired areas. For example, the outer coating of the wall portions may have a black or white colour or may be shadowed from black to white.

The light box may comprise an upper portion 15 which faces the hob plate 2 and which is adapted to emit light to the bottom side 2.2 of the hob plate 2. Due to the at least semi-transparent hob plate 2, the light provided to the bottom side 2.2 passes through said hob plate 2 and forms a light marking 4 which can be visually perceived by a user of the hob.

In order to homogenize the light, a light diffusor 17 may be provided at the upper portion 15 of the light box 10. Said light diffusor 17 may be, for example a diffusor plate or a diffusor foil. Said light diffusor 17 may be adapted to spatially homogenize the light provided by the light box 10 in order to achieve a spatially homogenous light marking 4. Alternatively or in addition, at the upper portion 15 a lid may be provided, said lid at least partially covering the opening through which light is emitted in order to confine the width of the light marking 4.

Figure 8:
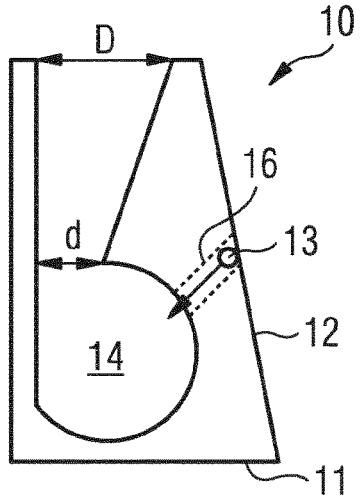
FIG. 8 illustrates an example schematic cross-sectional side view of a light box according to a second embodiment.
Figure 9:
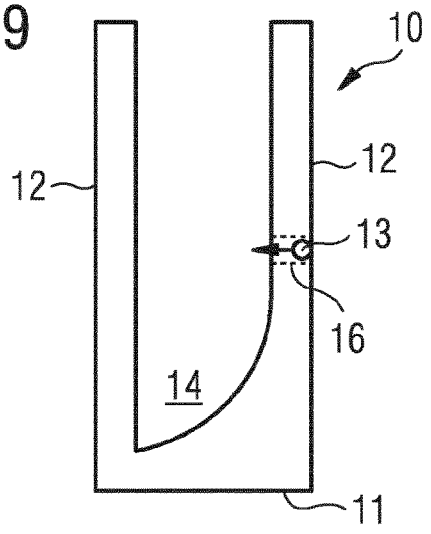
FIG. 9 illustrates an example schematic cross-sectional side view of a light box according to a third embodiment.
Figure 10:
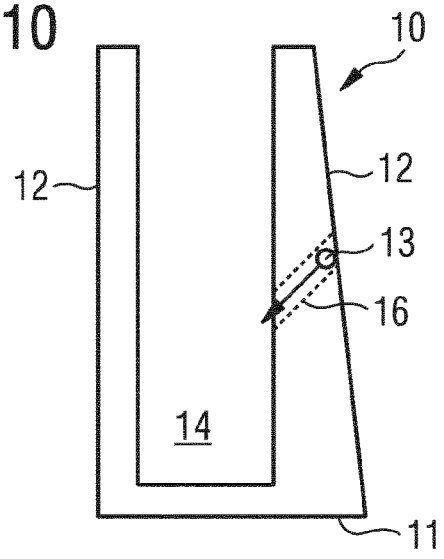
FIG. 10 illustrates an example schematic cross-sectional side view of a light box according to a fourth embodiment.

FIGS. 8 to 10 show different cross-sectional views of light boxes 10. The embodiment of FIG. 1 comprises a concave-shaped interior space 14. Said concave-shaped interior space 14 is obtained by a concave-shaped bottom wall portion 11 and at least one concave-shaped side wall portion 12. The distance d between said side wall portions in the area of the interior space 14 may be smaller than the distance D at the upper edge 10.1 of the light box 10. In other words, the shaping of at least one of the side wall portions 12 is chosen such that the light passage is limited by an edge formed at the concave-shaped side wall portion 12. Thereby it is possible to place the lighting elements 13 in an area which does not have a direct line of sight to the light emitting aperture 18 provided at the upper portion 15.

According to another embodiment, the bottom wall portion 11 and the side wall portion 12 may have a curved shape only in a corner area between the bottom wall portion 11 and the side wall portion 12 (FIG. 9). In other words, at least one corner area in the interior space 14 of the light box 10 is replaced by a rounded corner which further improves the homogeneity of light emission of the light box 10. Alternatively or in addition, at least one of the side wall portions 12 may have a tapered shape, specifically, the wall thickness increases from the upper edge 11.1 to the bottom wall portion 11 (FIG. 10).

As shown in FIGS. 8 to 10, the lighting elements 13 may not be directly placed within the interior space 14 of the light box 10 but at least one side wall portion 12 may comprise an aperture 16 which passes through the said side wall portion 12 thereby providing a light passage through the said side wall portion 12.

A lighting element 13 may be placed within said aperture 16 in order to provide light through said light passage into the interior space 14 of the light box 10 (as indicated by the arrow). The longitudinal axis of the aperture 16 providing said light passage may be arranged in parallel to the bottom wall portion 11 or may be provided in a slanted arrangement, i.e. the longitudinal axis of the light passage is slanted with respect to the longitudinal axis of the bottom wall portion 11. In a further embodiment, the lighting elements 13 may be placed at one or both lateral free ends of the elongated light box 10.

By means of one or more of said light boxes 10, different markings of the heating zones 5 are possible. For example, the light box may be adapted to provide an illumination ring or illumination strip around the heating zone 5. Alternatively, multiple segmented illumination stripes may indicate the position and size of the heating zone 5 (bracket-like illumination stripes, illumination stripes in the corner region). In addition, one or more light dots may be provided in the middle of said heating zone 5 in order to indicate the center of the heating zone 5.

Preferably, the light box 10 may be adapted to indicated the cooking level by optical indicators. For example, the light box may be adapted to change the intensity of color based on the chosen cooking level. According to other embodiments, the light box 10 may be adapted to change the color of the illumination stripes provided at the hob plate (e.g. yellow (low cooking level) to red (high cooking level)). Alternatively, the light box 10 may be adapted to change the thickness of the provided illumination stripe based on the chosen cooking level (thin line (low cooking level), thick line (high cooking level)). Still alternatively, the number of illumination stripes provided around the heating zone 5 may be adapted according to the chosen cooking level. It is worth mentioning that said upper-mentioned embodiments for illustrating the cooking level can be freely combined with each other.

It should be noted that the description and drawings merely illustrate the principles of the proposed methods and systems. Those skilled in the art will be able to implement various arrangements that, although not explicitly described or shown herein, embody the principles of the invention.

LIST OF REFERENCE NUMERALS

1 hob
2 hob plate
2.1 upper side
2.2 bottom side
3 heating element
4 light marking
5 heating zone
6 user interface
7 carrier plate
10 light box
10.1 upper edge
11 bottom wall portion
12 side wall portion
13 lighting element
14 interior space
15 upper portion
16 aperture
17 light diffusing portion
18 light emitting aperture
d distance
D distance

The invention claimed is:

1. A hob comprising:

a transparent or semi-transparent hob plate;

multiple heating elements arranged below said hob plate;

illumination means arranged below said hob plate for providing light markings at an upper side of the hob plate, said light markings varying to indicate selected or activated heating zones associated with the heating elements, wherein the illumination means comprise a light box with at least a bottom wall portion and a pair of side wall portions, said light box including one or more lighting elements for illuminating an interior space of the light box, wherein the light box further comprises an upper portion being adapted to emit light towards the hob plate in order to provide said light marking at the upper side of the hob plate.

2. The hob according to claim 1, wherein the bottom wall portion and the side wall portions are integrally formed at the light box.

3. The hob according to claim 1, wherein at least one side wall portion of the light box comprises one or more apertures through which light is emitted into an interior space of the light box.

4. The hob according to claim 1, wherein the bottom wall portion is formed by a circuit board comprising said lighting elements.

5. The hob according to claim 1, wherein the wall portions of the light box comprise a light blocking material or a light-blocking finishing or coating at the outer side.

6. The hob according to claim 1, wherein the interior surface of the light box is adapted to diffuse and/or reflect light.

7. The hob according to claim 6, wherein at least the side wall portions of the light box are made of white, non-transparent material or comprise a light-dispersive and/or light-reflecting coating.

8. The hob according to claim 1, wherein the light box comprises at its top side a light diffusing portion which faces a bottom side of the hob plate.

9. The hob according to claim 8, wherein the light diffusing portion is made by a rigid diffusor plate or a diffusor foil.

10. The hob according to claim 1, comprising a lid which partially covers an opening of the light box in order to provide a narrowed light emitting aperture.

11. The hob according to claim 1, wherein the light box is made of heat resistant polybutylene terephthalate (PBT).

12. The hob according to claim 1, comprising multiple said light boxes being arranged at different positions below said hob plate, the lighting elements included in the respective light boxes being driven such that a heating zone formed by one or more of said heating elements is highlighted at the upper side of the hob plate.

13. The hob according to claim 12, wherein said multiple light boxes are adapted to highlight heating zones by completely bordering said heating zones by a solid illumination line or by partially bordering the heating zones by broken lines.

14. The hob according to claim 1, comprising a control unit being adapted to control illumination properties provided by the light box based on a cooking level, by changing at least one of light intensity, colour, line width and number of lines of the light markings.

15. The hob according to claim 1, comprising control means for selecting the size of a heating zone wherein the light marking provided by said light box is adapted based on the selected size of the heating zone, or comprising a pot detection mechanism for choosing an appropriate size of the heating zone wherein the light marking indicating the size of the heating zone is adapted based on information provided by the pot detection mechanism.

16. A hob comprising:

a transparent or semi-transparent hob plate, a plurality of heating elements arranged below said hob plate and configured to provide a plurality of variable heating zones having different shapes and sizes based on either a user selection or a pot-detection system detecting an arrangement of cookware on an upper side of the hob plate, a plurality of light boxes also arranged below said hob plate in an array that encompasses said plurality of variable heating zones, and a controller;

each said light box having non-transparent and light-reflective or -diffusive interior walls that define an interior space of the light box, an LED for generating light that permeates said interior space, said interior space being in light communication with a bottom side of said hob plate through an opening of said light box so that light from said interior space is visible from said upper side of said hob plate, a diffuser disposed adjacent said opening to diffuse light exiting said interior space toward said bottom side of said hob plate, said LED being positioned so that it is not in direct line-of-sight with said opening;

said bottom side of said hob comprising a printed or coated layer that defines one or more light transmission slots in the hob layer to confine light emitted from the array of light boxes to defined apertures;

said controller being operatively connected to and configured to selectively operate said array of light boxes in order to generate variable light markings visible from said upper side of said hob that indicate the size and shape of active heating zones;

said upper side of said hob plate being devoid of fixed markings to indicate heating zones.

17. The hob according to claim 16, said controller further configured to regulate at least one of light intensity, color or thickness of said light markings based on an operative cooking level for an associated heating zone.

18. The hob according to claim 1, wherein at least one of the lighting elements is arranged outside the interior space of the light box and at least one side wall portion of the light box comprises one or more apertures through which light from the at least one of the lighting elements is emitted into an interior space of the light box.

* * * * *